US010113297B1

(12) United States Patent
Henning et al.

(10) Patent No.: US 10,113,297 B1
(45) Date of Patent: Oct. 30, 2018

(54) BACK GUARD ATTACHABLE TO A BUCKET, METHOD OF FORMING THE BACK GUARD, AND BUCKET ASSEMBLY INCLUDING THE BACK GUARD

(71) Applicant: R2 Manufacturing LLC, Point of Rocks, MD (US)

(72) Inventors: Ryan G. Henning, Leesburg, VA (US); Robert K. Henning, Alden, NY (US)

(73) Assignee: R2 MANUFACTURING LLC, Point of Rocks, MD (US)

( * ) Notice: Subject to any disclaimer, the term of this patent is extended or adjusted under 35 U.S.C. 154(b) by 0 days.

(21) Appl. No.: 15/896,017

(22) Filed: Feb. 13, 2018

(51) Int. Cl.
*E02F 9/24* (2006.01)
*E02F 3/815* (2006.01)
*E02F 3/40* (2006.01)

(52) U.S. Cl.
CPC ..... *E02F 3/8152* (2013.01); *E02F 3/40* (2013.01); *E02F 3/401* (2013.01); *E02F 9/24* (2013.01)

(58) Field of Classification Search
CPC ..... E02F 9/24; E02F 3/40
See application file for complete search history.

(56) References Cited

U.S. PATENT DOCUMENTS 3,195,250 A 7/1965 Robinson
4,395,193 A 7/1983 Christensen et al.
4,477,987 A 10/1984 Stecklein
5,392,864 A 2/1995 Lindenmuth
5,860,230 A * 1/1999 Daniels ..... E01H 5/06 172/816
5,915,914 A 6/1999 Hadiken
6,425,196 B1 * 7/2002 Weagley ..... E01H 5/065 172/393
6,901,978 B2 * 6/2005 Simpson ..... A01G 23/087 144/339
7,429,158 B2 * 9/2008 McFarland ..... E02F 3/401 37/274
7,647,713 B2 * 1/2010 Malacrino ..... E02F 3/40 37/409
7,762,014 B2 7/2010 Brock et al.
9,359,734 B2 * 6/2016 Favorito ..... E01H 5/09
2007/0212207 A1 * 9/2007 Gust ..... E02F 3/40 414/722

FOREIGN PATENT DOCUMENTS

JP 2001032318 A * 2/2001

* cited by examiner

*Primary Examiner* — Gerald McClain
(74) *Attorney, Agent, or Firm* — Rossi, Kimms & McDowell LLP

(57) ABSTRACT

A back guard for a loader bucket is removably mountable to the bucket and can accommodate buckets having different widths. A bucket assembly that includes the bucket and the back guard can accommodate stacked items, such as wood, for transport on the loader bucket. It has a back plate sufficiently strong to hold debris, while not obstructing the vision of the tractor operator. The back plate is slideably disposed relative to left and right supports that are mountable, respectively to the left and right sides of the bucket to provide a sliding mechanism. Each side of the back guard can accept additional implementations, such as left and right side guards useful for further containing the items in the bucket, so that more items can be transported. A method of forming the back guard includes welding components thereof.

18 Claims, 4 Drawing Sheets

BACK GUARD ATTACHABLE TO A BUCKET, METHOD OF FORMING THE BACK GUARD, AND BUCKET ASSEMBLY INCLUDING THE BACK GUARD

BACKGROUND

Conventional front loader buckets (hereafter "buckets") are useful for moving and lifting material. It would be desirable, for those who have a tractor or the like, to be able to use the bucket to also transport stackable items, such as wood, lumber, poles, or slender objects. But there is a risk of these items falling over the rear side of the bucket, where it can damage bucket arms, hydraulic lines, the hood of the tractor, or even the operator.

Some examples of debris or spill guards for preventing debris from falling rearwardly from the bucket for tractors are described in U.S. Pat. Nos. 3,195,250; 4,395,193; 4,477,987; 5,392,864; 5,915,914; 7,762,014 and USPGP 2007/0212207.

The present development addresses the need for transporting stackable items, such as woods, lumber, poles, or slender objects, using conventional buckets.

SUMMARY OF THE INVENTION

One aspect of the present development is a back guard attachable to a bucket and extend across the width thereof at a rearward position of the bucket. The back guard includes a left support, a right support, a back support, and an adjustment mechanism. The left support is attachable to a left side of the bucket. The right support is attachable to a right side of the bucket. The back support is connectable to the left support and the right support. The back support extends upwardly from a rear side of the bucket, in a state where the back guard is attached to the bucket. The adjustment mechanism permits the back support to accommodate different buckets having different widths.

The left support includes a left side post and a first left bar that extends from the left side post laterally toward the right side of the bucket, in the state where the back guard is attached to the bucket. The right support includes a right side post and a first right bar that extends from the right side post laterally toward the left side of the bucket, in the state where the back guard is attached to the bucket. The left side post is attachable to the left side of the bucket, and the right side post is attachable to the right side of the bucket.

The back support includes a first bar and a support plate fixed to the first bar. The support plate and the first bar extend between the left side post and the right side post, in the state where the back guard is attached to the bucket.

The adjustment mechanism can include the first left bar and the first bar that are slideably arranged from a left side of the back support, and the first right bar and the first bar that are slideably arranged from a right side of the back support, in the state where the back guard is attached to the bucket, to allow the back support to accommodate buckets having different widths.

The back support is laterally displaceable (i.e., movable left-right direction) relative to the left and right side posts, and the back support can be anchored to at least one of the first left or right bar, in the state where the back guard is attached to the bucket to prevent the back support from laterally displacing relative to the left and right supports during use.

The back support can include a second bar that extends between the left side post and the right side post, in the state where the back guard is attached to the bucket. The left support can include a second left bar vertically spaced from the first left bar and extending from the left side post laterally toward the right side of the bucket, in the state where the back guard is attached to the bucket. The right support can include a second right bar vertically spaced from the second right bar and extending from the right side post laterally toward the left side of the bucket, in the state where the back guard is attached to the bucket. The support plate can be further fixed to the second bar and include a plurality of openings.

The adjustment mechanism can further includes the second left bar and the second bar that are slideably arranged from the left side of the back support and the second right bar and the second bar that are slideably arranged from the right side of the back support, in the state where the back guard is attached to the bucket.

Each of the first and second bars can be tubular so that the first bar slideably receives the first left bar and the first right bar and the second bar slideably receives the second left bar and the second right bar.

The left support can include a left side plate member extending from the left side post laterally toward the right side of the bucket, and the right support can includes a right side plate member extending from the right side post laterally toward the left side of the bucket, in the state where the back guard is attached to the bucket. The left side plate member is configured to overlap a left side of the support plate and the right side plate member is configured to overlap a right side of the support plate, in the state where the back guard is attached to the bucket.

The back guard can further include a mechanism for implementing accessories. Specifically, the back guard include a left side guard attachable to the left support, and a right side guard attachable to the right support. The left and right side guards extend forwardly toward a front side of the bucket, in the state where the back guard is attached to the bucket.

Each of the left and right side guards can include a plurality of extension members, and each of the left and right side guards can include a plurality of mounting receptacles that receive the respectively plurality of extension members.

The back guard can further include a left support rod connecting the left side guard and the support plate, and a right support rod connecting the right side guard and the support plate.

Another aspect is a bucket assembly for moving material. The bucket assembly includes a bucket and the back guard described above.

Another aspect is a method of forming the back guard described above. The method comprises the steps of joining (e.g., welding) the first left bar at right angles to the left side post to form the left support, joining (e.g., welding) the first right bar at right angles to the right side post to form the right support, and joining (e.g., welding) the first bar to the support plate to form the back support.

DETAILED DESCRIPTION

The present development combines the versatility of the bucket with additional functionalities that are also economical, namely the ability to move more materials with reduced risk of having the materials fall behind the bucket, with a minimal modification (holes) to the bucket itself.

The present back guard (or TOP TAMER™ coined by applicant) is a multi-functional, removable and universally adjustable attachment for a bucket that also serves to hold stacked wood, in particular firewood, for transport on the bucket. The present development provides an easily removable back guard for a bucket that provide a universal fit, to allow transporting of stackable or elongated items, such as stacked wood, posts, rods, etc., as well as other items. Attaching the back guard merely requires drilling of holes at the left and right sides of the bucket. The back guard can be removably attached to the bucket with fasteners.

The present back guard allows the tractor operator to push items, such as brush and debris, with a conventional bucket, in particular materials that can easily slide over the top of the bucket, damaging the bucket arms or the front of the tractor. It also allows holding of more stacked wood for transport than can be accomplished by piling or stacking wood in the bucket by itself.

When the material is stackable wood, for example, the back guard can prevent the stacked wood from falling backward. Moreover, when combined with side support extensions, the back guard also prevents the stacked wood from falling sideward. Additionally, the width of the rear guard itself can be adjustable to provide a universal fit for buckets of different widths. The universal fit makes the present development more practical, since the back guard need not be custom fit to each bucket, and useful for transferring between buckets of differing widths.

Figure 1:
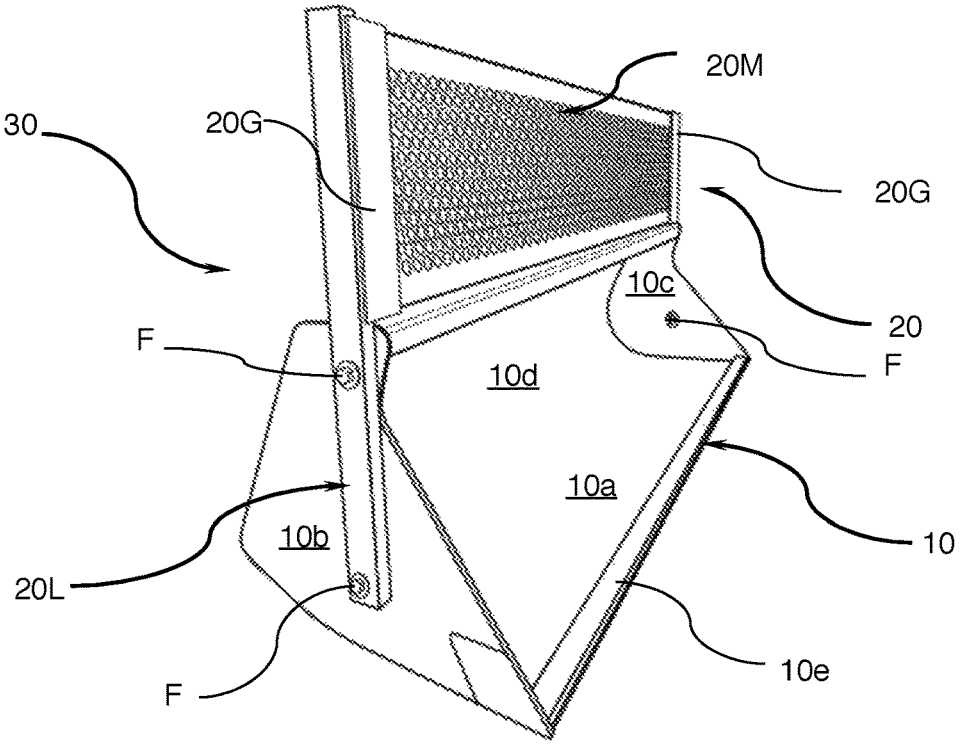
FIG. 1 illustrates a first embodiment of a bucket assembly that includes a conventional bucket and a back guard according to a first embodiment of the present development mounted to the bucket.
Figure 7:
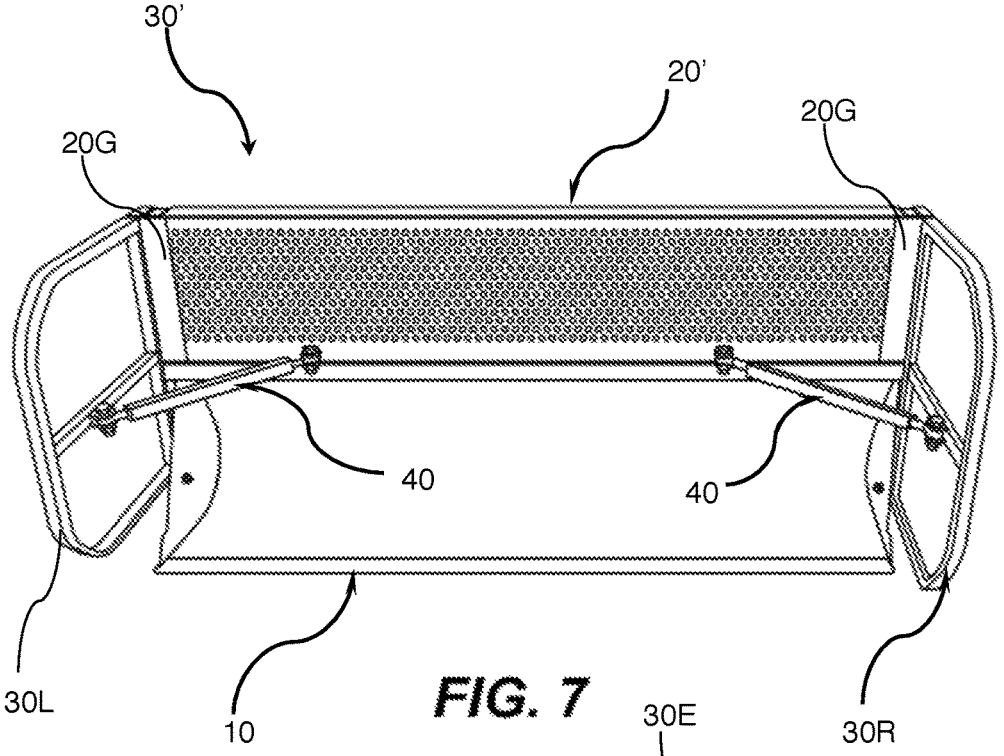
FIG. 7 illustrates a perspective view of a second embodiment of the bucket assembly that incorporates the second embodiment of the back guard and with left and right side guards.
Figure 8:
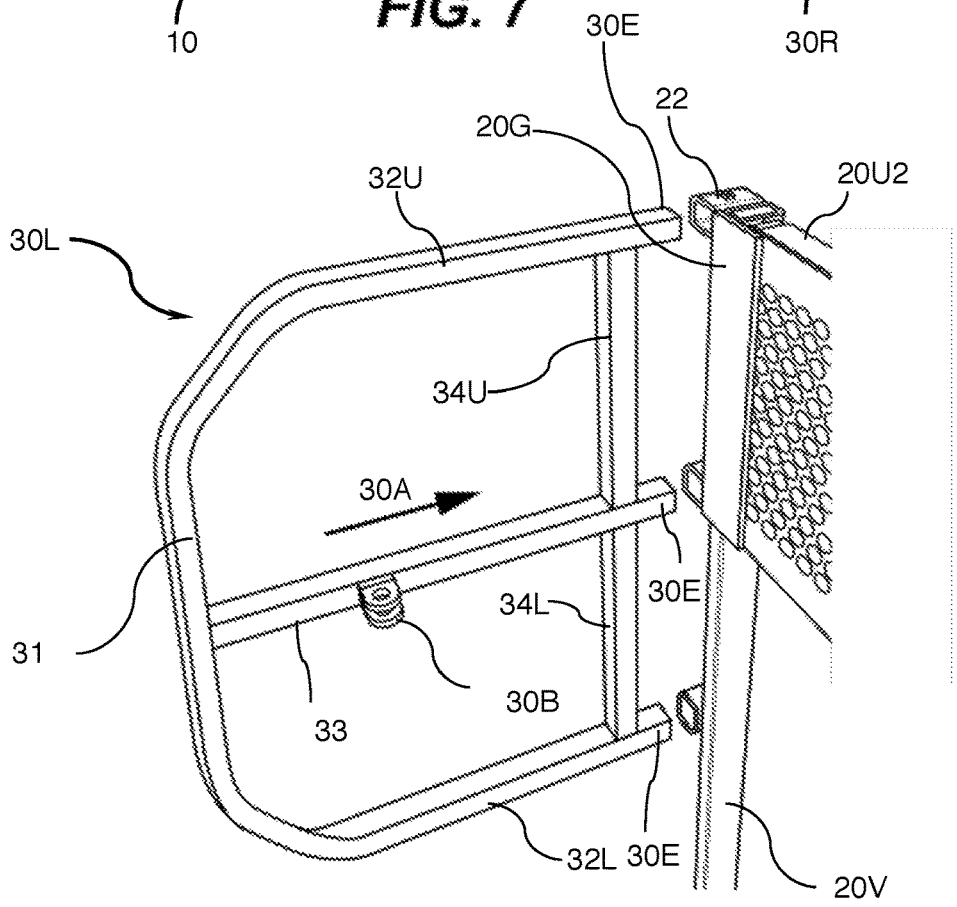
FIG. 8 illustrates an exploded perspective view illustrating how the left side guard is mounted to the left support in the second embodiment.

FIG. 1 illustrates a first embodiment of a bucket assembly 30 and FIG. 7 illustrates a second embodiment of a bucket assembly 30'. The bucket assembly 30, 30' comprises a bucket 10 and a back guard 20, 20'.

The bucket 10 can be any conventional or commercial bucket that is typically associated with tractors or heavy equipment machines. The bucket is typically configured to have an inner volume sufficient to hold loose materials, such as dirt, sand, rocks, and even snow. Specifically, referring to FIG. 1, the bucket 10 typically can have a bottom wall 10*a*, left and right side walls 10*b*, 10*c*, and a back wall 10*d* all integrally held together to form a rigid structure having the inner volume sufficient to hold materials. Excavator buckets can even have teeth protruding from its front edge 10*e*, and configured to disrupt material. The bucket 10 also has a connecting mechanism (not shown) for attaching to a tractor or the like. The connecting mechanism is conventional (and thus not described or illustrated).

Figure 2:
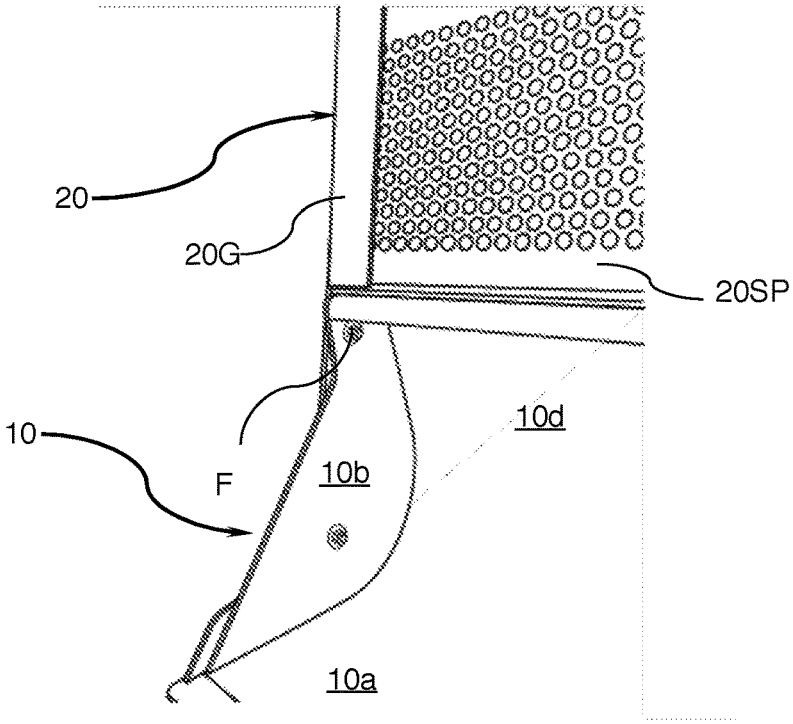
FIG. 2 illustrates a view of the right side of the bucket showing an example of how the back guard is attached to the bucket.
Figure 3:
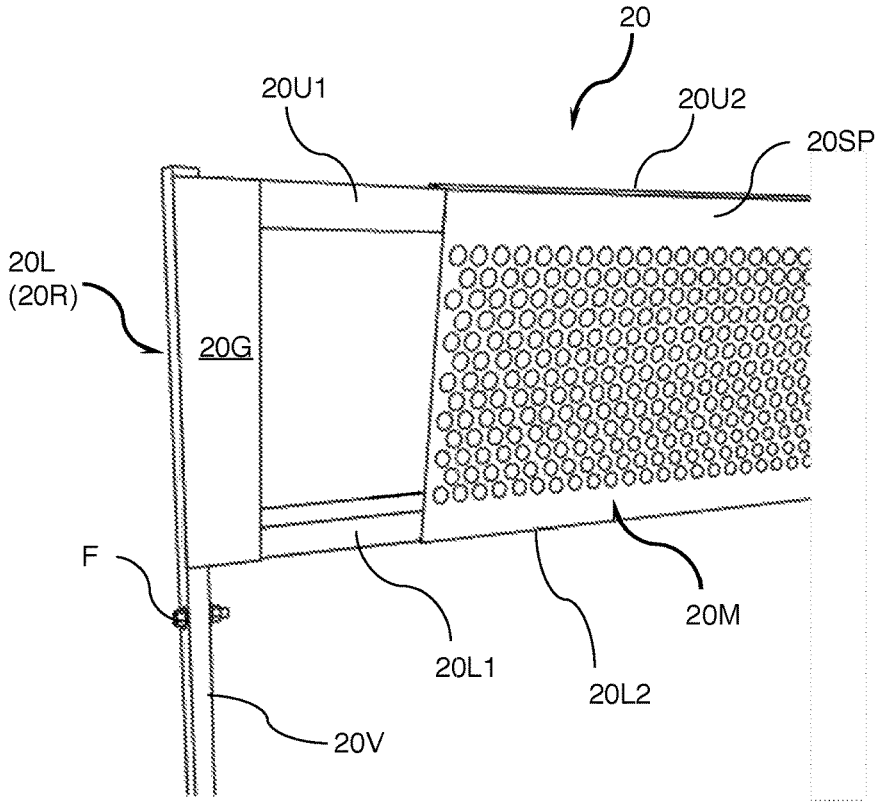
FIG. 3 illustrates the back guard according to the first embodiment, with the back support in an extended position.
Figure 4:
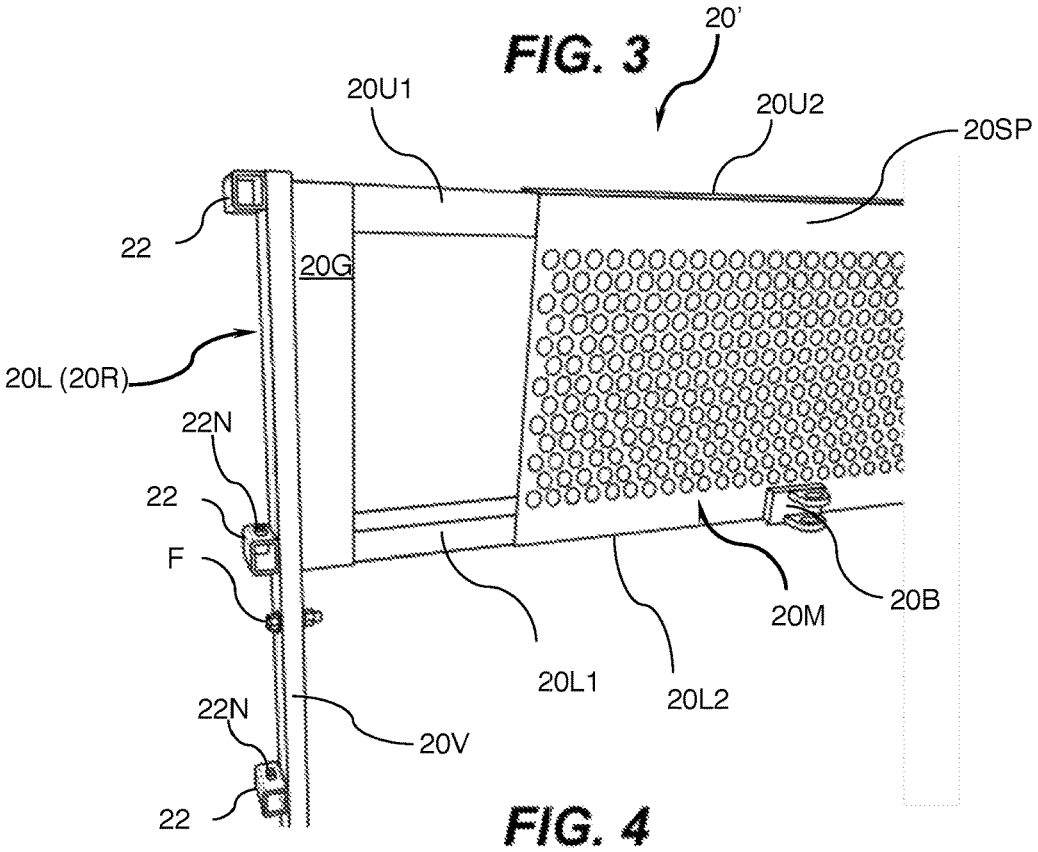
FIG. 4 illustrates a second embodiment of the back guard according to the present development, which is similar to the first embodiment, but with an auxiliary mounting adapter for mounting an (left) accessory, such as a left side guard.
Figure 5:
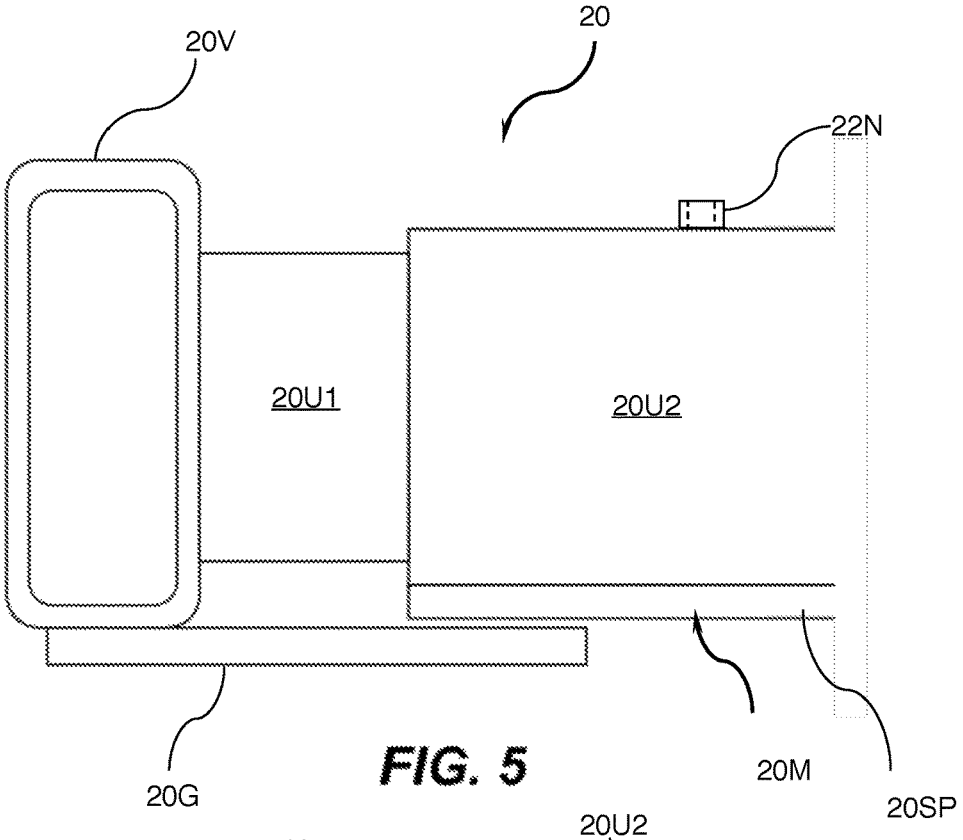
FIG. 5 illustrates a top view of the first embodiment of the back guard, illustrating the back support plate overlapping with a left side plate member.
Figure 6:
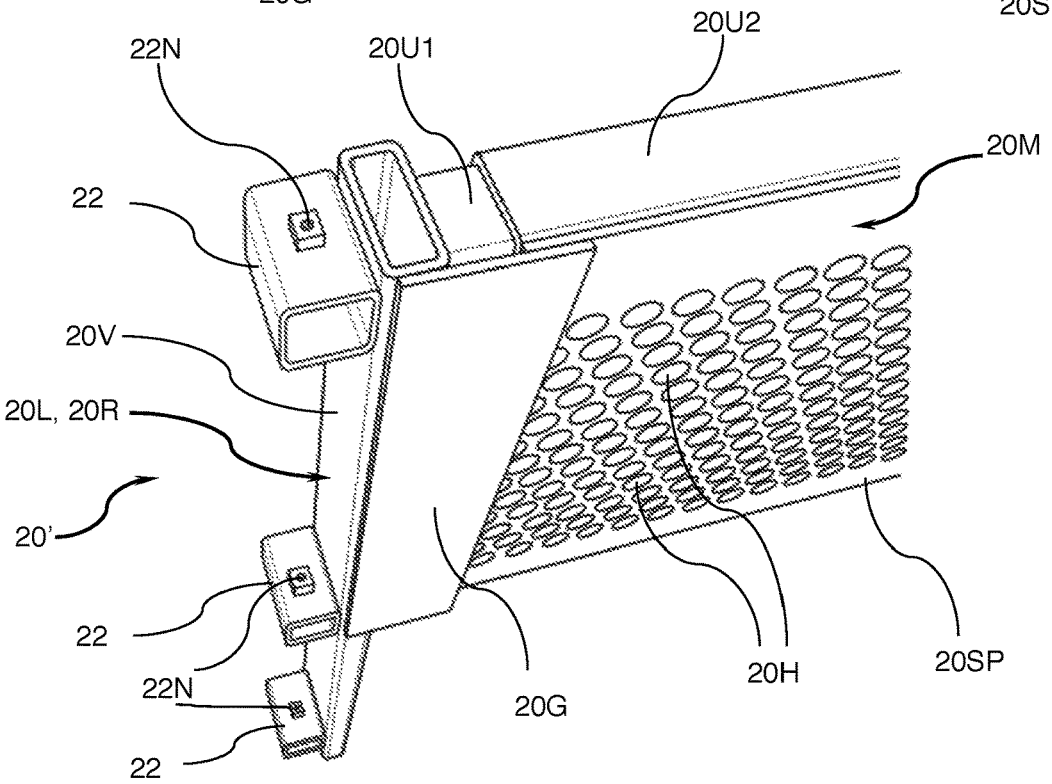
FIG. 6 illustrates a perspective view of the second embodiment of the back guard, which is similar to FIG. 5, where the back support plate overlaps the left side plate member.

Referring to FIGS. 1, 2, and 7, the back guard 20, 20' includes a left support 20L, a back support 20M, and a right support 20R, which mirrors the left support 20L. These supports, when assembled together, form a rigid frame that is sufficiently strong to support materials or items to be carried by the bucket. The frame, for example, can be welded tubular members. The left and right supports have a mirror image configuration. Accordingly, the right support itself is not illustrated in detail.

Referring to FIGS. 1-2, each of the left and right supports 20L, 20R includes a vertically extending side post 20V. The side post 20V of the left support 20L is attachable to the left side, namely the left side wall 10*b*, of the bucket 10, and the side post 20V of the right support 20R is attachable to the right side, namely the right side wall 10*c*, of the bucket 10, using multiple fasteners F. In the illustrated embodiments, two mounting holes are provided in each of the side post 20V for receiving fasteners F, which can be a bolt/nut arrangement, corresponding to two holes drilled through each of left and right side walls 10*b*, 10*c* of the bucket 10. Additional mounting holes and fasteners can be used to securely attach the left and right supports 20L, 20R to the respective side walls 10*b*, 10*c* of the bucket 10.

In the illustrated embodiments, the left support 20L includes an upper (first) left bar 20U1 and a lower (second) left bar 20L1 spaced vertically from and parallel with the upper left bar 20U1. Both the upper and lower left bars 20U1, 20L1 extend laterally toward the right side of the bucket 10, in the state where the back guard 20 is attached to the bucket 10. Similarly, the right support 20L includes an upper (first) right bar 20U1 and a lower (second) right bar 20L1 spaced vertically from and parallel with the upper right bar 20U1. Both the upper and lower right bars extend laterally toward the left side of the bucket 10, in the state where the back guard 20 is attached to the bucket 10. Again, since the upper and lower right bars mirror the upper and lower left bars, the details of the right side are not shown.

The left vertically extending side post 20V corresponds to a main left support member and right vertically extending side post 20V corresponds to a main right support member. The upper left bar 20U1 and the lower bar 20L1 both extend laterally outwardly from the main left support member. Similarly, the first right bar 20U1 and the lower right bar 20L1 extend laterally outwardly from the main left support member.

The left support 20L further includes a left side (protective) plate member 20G extending laterally toward the right side of the bucket 10 and extending vertically between the upper left bar 20U1 and the lower left bar 20L1. Similarly, the right support 20R includes a right side (protective) plate member 20G extending laterally toward the left side of the bucket and extending vertically between the upper right bar 20U1 and the lower right bar 20L1. The left side plate member 20G is dimensioned to overlap the left side of the support plate 20SP and the right side plate member is dimensioned to overlap the right side of the support plate 20SP, in the state where the back guard 20 is attached to the bucket 10.

The upper and lower left bars 20U1, 20L1 can be welded to the left side post 20V at right angles. Support brackets (not shown) can be welded to the left side post 20V and the upper and lower left bars 20U1, 20L1 for strengthening purposes. Similarly, the upper and lower right bars 20U1, 20L1 can be welded to the right side post 20V at right angles. Support brackets (not shown) also can be welded to the right side post 20V and the upper and lower right bars 20U1, 20L1 for strengthening purposes. Moreover, the length of the upper and lower left and right bars 20U1, 20L1 each can be shorter than half the width of the bucket to provide a flexible fit, as well as to provide redundant strength during operation. The length, however, can be any length sufficient to support the back support 20M. For example, the length of the upper and lower left and right bars 20U1, 20L1 can be made to overlap only one foot or greater on each of left and right side with upper and lower bars 20U2, 20L2 of the back support 20M.

The back support 20M is connectable to the left support 20L and the right support 20R, with the back support 20M disposed extending upwardly above the rear side wall 10*d* of the bucket 10 when the back guard 20 is attached to the bucket 10. The back support 20M includes an upper (first) bar 20U2, a lower (second) bar 20L2, and a support plate 20SP fixed, such as welded, to the upper bar 20U2 and the lower bar 20L2. The upper and lower bars 20U2, 20L2 are parallel. The support plate 20SP includes a plurality of openings to not obstruct the vision of the tractor operator. In this respect, the support plate 20SP can be a mesh screen plate sufficiently strong to support materials being carried and not obstruct the vision of the tractor operator. The support plate 20SP can be a mesh screen plate made from expanded metal and welded to the upper and lower bars 20U2, 20L2.

The support plate 20SP fixed to the upper and lower bars 20U2, 20L2 extends between the left support 20L and the right support 20R, in the state where the back guard 20 is attached to the bucket 10.

The upper and lower bars 20U2, 20L2 each can be tubular and having the same dimension and configuration, and spaced vertically corresponding to the upper and lower left and right bars 20U1, 20L1. The upper bar 20U2 slideably receives the upper left bar 20U1 from the left side and the upper right bar 20U1 from the right side. Similarly, the lower bar 20L2 slideably receives the lower left bar 20L1 from the left side and the lower right bar 20L1 from the right side. The back support 20M thus extends between the left support 20L and the right support 20R and is laterally displaceable (i.e., left-right direction) relative to the left and right supports 20L, 20R, in the state where the back guard is attached to the bucket 10.

The back support 20M is anchored to at least one of the left or right support 20L, 20R, in the state where the back guard is attached to the bucket to prevent the back support from laterally displacing relative to the left and right supports. Specifically, at least one of the upper or lower bar 20U2, 20L2 can have at least one nut 22N or bung with threading welded thereto for receiving a bolt or set screw, which can be fastened thereto and wedge the upper left or right bar 20U1 or the lower left or right bar 20U1, 20L1. Preferably, at least four nuts 22N are welded to the back support, at least two on the upper support 20U2, at least one on left and right sides to anchor the upper left and right bars 20U1 with bolts or sets crews, and at least two on the lower support 20U2, at least one on left and right sides to anchor the lower left and right bars 20L1 with bolts or set screws. This secures the back support 20M to both the left and right supports 20L, 20R to prevent movement of the back support 20M during use.

The back guard 20 includes an adjustment mechanism that permits the back support 20M to accommodate different buckets having different widths. The adjustment mechanism includes the left upper bar 20U1 and the upper bar 20U2 that are slideably arranged and the left lower bar 20L1 and the lower bar 20L2 that are slideably arranged from the left side of the back support 20M, and the right upper bar 20U1 and the upper bar 20U2 that are slideably arranged and the right lower bar 20L1 and the lower bar 20L2 that are slideably arranged from the right side of the back support 20M, in the state where the back guard 20 is attached to the bucket 10, to allow the back support 20M to accommodate buckets having different widths. By using the present arrangement of sliding coupling the left and right side supports, the back guard 20 is adjustable in width to provide a universal fit, and can be centered relative to the bucket or moved left or right of the center. Bolt or set screws can be fastened to the nuts 22N to anchor the back guard 20M from moving relative to the left and right supports 20L, 20R.

As previously described, the left side plate member 20G extend laterally toward the right side of the bucket 10 and the right side plate member 20G extends laterally toward the left side of the bucket so that the side plate members 20G overlap the left side of the support plate 20SP and the right side of the support plate 20SP. This allows for lateral adjustment of the back support relative to the left and right supports 20L, 20R to accommodate buckets have different widths, while hiding the left and right ends of the back support plate 20SP. Moreover, the same left and right supports 20L, 20R can be used for buckets having vastly different widths by merely using different back guards 20M having different widths, with each back guard 20M usable with different buckets having a predetermined range of widths.

FIGS. 4, 6, 7, and 8 illustrate a second embodiment of the back guard 20,' which is essentially identical to the back guard 20, but further includes an auxiliary mounting adapter for mounting an accessory, such as the side guard 30L, 30R. The support plate 20SP includes left and right brackets 20B fixed thereto, such as by welding, to respectively receive left and right support rod 40, which is conventional. Specifically, each support rod can have a threaded tubular bar, which threadingly receives an eyelet with a threading that is threadingly inserted from each end of the threaded tubular member. This allows the length between the center of two eyelets to be adjusted for different lengths. Additional nuts at either end of the threaded tubular member can be used to anchor the eyelets to the threaded tubular bar.

Referring to FIG. 7, the side guards 30L, 30R extend forwardly of the bucket, in the state where the back guard 20' is attached to the bucket 10, and prevent stacked material inside the bucket 10 from falling out the sides of the bucket 10. A left side guard 30L is attachable to the left support 20L and a right side guard 30R is attachable to the right support 20R. The left and right side guards 30L, 30R Each of the left and right side guards 30L, 30R includes an upper bar 32U, a lower bar 32L and a connecting bar 31 that connects the upper and lower bars 32U, 32L to provide a U-shape. Specifically, each of the left and right side guards 30L, 30R can be made of a U-shaped bar. A center support bar 33 can extend parallel to the upper and lower bars 32U, 32L, and an upper support bar 34U and a lower support bar 34L can extend between the center support bar 33 and the upper and lower bars 32U, 32L, respectively. The upper bar 32U, the center support bar 33, and the lower bar 32L have ends that protrude beyond the upper support bar 34U and the lower support bar 34L. The protrusions correspond to a plurality of extension members 30E. The overall configuration of each of the left and right side guards 30L, 30R can have any shape that is useful, although the present drawings illustrate a generally rectangular shape.

In the second embodiment, each of the left and right side posts includes a plurality of accessory mounting receptacles 22 that slidingly receives the respectively plurality of extension members 30E. The receptacles are tubular members similar to the upper and lower bars 20U2, 20L2 of the back support 20M, but having a shorter length. The receptacles 22 can be welded to each of the left and right side posts 20V. The nut 22N or bung hole with threading can be welded to each of the receptacles 22. A bolt or a set screw is threaded to each nut 22N to secure the side guard after sliding the extension members 30E into the respective receptacles 22. This secures the side guard, as well as allowing fore and aft adjustment of the side guard and its removal.

The left support rod 40 connects to a bracket 30B fixed (e.g., welded) to the center support bar of the left side guard 30L and the bracket 20B fixed (e.g., welded) to the support plate 20M on the left side thereof, and the right support rod 40 connects to a bracket 30B fixed (e.g., welded) to the center bar of the right side guard 30R and the bracket 20B fixed (e.g., welded) to the support plate 20M on the right side thereof, to support the side guards 30L, 30R. Each of the brackets 20B, 30B can have an ear bracket configuration where a pair of upright ears or arms straddle the eyelet of the support rod 40. The ears each have a hole to permit insertion of a fastener, such as a bolt or the like, to retain the eyelet between the ears with the fastener.

Moreover, although not illustrated, each of the left and right side guards 30L, 30R can further including a backing plate welded to the upper and lower bars 32U, 32L and the connecting bar 31 to allow containment of loose or granular material, any other material.

In the present description, the directions (left, right, upper, and lower) are intended to be merely relative or in relation to the bucket as viewed from the front of the bucket for ease of description. The directional descriptors thus are not absolute. Rather, they merely provide a convenient way of identifying the illustrated elements in relation to the drawings as one would normally view them.

Given the present disclosure, one versed in the art would appreciate that there may be other embodiments and modifications within the scope and spirit of the present development. Accordingly, all modifications attainable by one versed in the art from the present disclosure within the scope and spirit of the present development are to be included as further embodiments of the present development. The scope of the present invention accordingly is to be defined as set forth in the appended claims.

What is claimed is:

1. A back guard attachable to a bucket, the back guard comprising:

a left support attachable to a left side of the bucket;

a right support attachable to a right side of the bucket;

a back support connectable to the left support and the right support, the back support extending upwardly from a rear side of the bucket, in a state where the back guard is attached to the bucket; and an adjustment mechanism that permits the back support to accommodate different buckets having different widths, wherein the left support includes a left side post and a first left bar that extends from the left side post laterally toward the right side of the bucket, in the state where the back guard is attached to the bucket, wherein the right support includes a right side post and a first right bar that extends from the right side post laterally toward the left side of the bucket, in the state where the back guard is attached to the bucket, wherein the back support includes a first bar and a support plate fixed to the first bar, the support plate and the first bar extending between the left side post and the right side post, in the state where the back guard is attached to the bucket, and wherein the adjustment mechanism includes the first left bar and the first bar that are slideably arranged from a left side of the back support, and the first right bar and the first bar that are slideably arranged from a right side of the back support, in the state where the back guard is attached to the bucket, to allow the back support to accommodate buckets having different widths, wherein the back support is:

laterally displaceable relative to the left and right side posts, and anchored to at least one of the first left or right bar, in the state where the back guard is attached to the bucket to prevent the back support from laterally displacing relative to the left and right supports during use.

2. The back guard according to claim 1, wherein:

the back support includes a second bar that extends between the left side post and the right side post, in the state where the back guard is attached to the bucket, the left support includes a second left bar vertically spaced from the first left bar and extending from the left side post laterally toward the right side of the bucket, in the state where the back guard is attached to the bucket, the right support includes a second right bar vertically spaced from the second right bar and extending from the right side post laterally toward the left side of the bucket, in the state where the back guard is attached to the bucket, and the adjustment mechanism further includes the second left bar and the second bar that are slideably arranged from the left side of the back support and the second right bar and the second bar that are slideably arranged from the right side of the back support, in the state where the back guard is attached to the bucket.

3. The back guard according to claim 2, wherein:

the left side post is attachable to the left side of the bucket, and the right side post is attachable to the right side of the bucket.

4. The back guard according to claim 3, wherein the support plate is further fixed to the second bar and includes a plurality of openings.

5. The back guard according to claim 3, wherein:

each of the first and second bars is tubular, the first bar slideably receives the first left bar and the first right bar, and the second bar slideably receives the second left bar and the second right bar.

6. The back guard according to claim 5, wherein:

the left support further includes a left side plate member extending from the left side post laterally toward the right side of the bucket, in the state where the back guard is attached to the bucket, the right support further includes a right side plate member extending from the right side post laterally toward the left side of the bucket, in the state where the back guard is attached to the bucket, and the left side plate member is configured to overlap a left side of the support plate and the right side plate member is configured to overlap a right side of the support plate, in the state where the back guard is attached to the bucket.

7. The back guard according to claim 1, further comprising:

a left side guard attachable to the left support; and a right side guard attachable to the right support, the left and right side guards each extending forwardly toward a front side of the bucket, in the state where the back guard is attached to the bucket.

8. The back guard according to claim 7, further comprising:

a left support rod connecting the left side guard and the support plate, and a right support rod connecting the right side guard and the support plate.

9. The back guard according to claim 7, wherein:

each of the left and right side guards includes a plurality of extension members, and each of the left and right side guards include a plurality of mounting receptacles that receive the respectively plurality of extension members.

10. A bucket assembly for moving material, the bucket assembly comprising:

a bucket; and a back guard attachable to the bucket and comprising:

a left support attachable to a left side of the bucket;

a right support attachable to a right side of the bucket;

a back support connectable to the left support and the right support, the back support extending upwardly from a rear side of the bucket, in a state where the back guard is attached to the bucket; and an adjustment mechanism that permits the back support to accommodate different buckets having different widths, wherein the left support includes a left side post and a first left bar that extends from the left side post laterally toward the right side of the bucket, in the state where the back guard is attached to the bucket, wherein the right support includes a right side post and a first right bar that extends from the right side post laterally toward the left side of the bucket, in the state where the back guard is attached to the bucket, wherein the back support includes a first bar and a support plate fixed to the first bar, the support plate and the first bar extending between the left side post and the right side post, in the state where the back guard is attached to the bucket, and wherein the adjustment mechanism includes the first left bar and the first bar that are slideably arranged from a left side of the back support, and the first right bar and the first bar that are slideably arranged from a right side of the back support, in the state where the back guard is attached to the bucket, to allow the back support to accommodate buckets having different widths;

wherein:

the back support is laterally displaceable relative to the left and right side posts, and the back support is anchored to at least one of the first left or right bar, in the state where the back guard is attached to the bucket to prevent the back support from laterally displacing relative to the left and right supports during use.

11. The bucket assembly according to claim 10, further comprising:

a left side guard attachable to the left support; and a right side guard attachable to the right support, the left and right side guards each extending forwardly toward a front side of the bucket, in the state where the back guard is attached to the bucket.

12. The bucket assembly according to claim 11, wherein:

each of the left and right side guards includes a plurality of extension members, and each of the left and right side guards include a plurality of mounting receptacles that receive the respectively plurality of extension members.

13. The bucket assembly according to claim 10, wherein:

the back support includes a second bar that extends between the left side post and the right side post, in the state where the back guard is attached to the bucket, the left support includes a second left bar vertically spaced from the first left bar and extending from the left side post laterally toward the right side of the bucket, in the state where the back guard is attached to the bucket, the right support includes a second right bar vertically spaced from the second right bar and extending from the right side post laterally toward the left side of the bucket, in the state where the back guard is attached to the bucket, and the adjustment mechanism further includes the second left bar and the second bar that are slideably arranged from the left side of the back support and the second right bar and the second bar that are slideably arranged from the right side of the back support, in the state where the back guard is attached to the bucket.

14. The bucket assembly according to claim 13, wherein:

the left side post is attachable to the left side of the bucket, and the right side post is attachable to the right side of the bucket.

15. The bucket assembly according to claim 14, wherein the support plate is further fixed to the second bar and includes a plurality of openings.

16. The bucket assembly according to claim 14, wherein:

each of the first and second bars is tubular, the first bar slideably receives the first left bar and the first right bar, and the second bar slideably receives the second left bar and the second right bar.

17. The bucket assembly according to claim 16, wherein:

the left support further includes a left side plate member extending from the left side post laterally toward the right side of the bucket, in the state where the back guard is attached to the bucket, the right support further includes a right side plate member extending from the right side post laterally toward the left side of the bucket, in the state where the back guard is attached to the bucket, and the left side plate member is configured to overlap a left side of the support plate and the right side plate member is configured to overlap a right side of the support plate, in the state where the back guard is attached to the bucket.

18. A method of forming a back guard attachable to a bucket, wherein the back guard comprises:

a left support attachable to a left side of the bucket;

a right support attachable to a right side of the bucket;

a back support connectable to the left support and the right support, the back support extending upwardly from a rear side of the bucket, in a state where the back guard is attached to the bucket; and wherein the left support includes a left side post and a first left bar that extends from the left side post laterally toward the right side of the bucket, in the state where the back guard is attached to the bucket, wherein the right support includes a right side post and a first right bar that extends from the right side post laterally toward the left side of the bucket, in the state where the back guard is attached to the bucket, wherein the back support includes a first bar and a support plate fixed to the first bar, the support plate and the first bar extending between the left side post and the right side post, in the state where the back guard is attached to the bucket, and wherein the first left bar and the first bar are slideably arranged from a left side of the back support, and the first right bar and the first bar that are slideably arranged from a right side of the back support, in the state where the back guard is attached to the bucket, to allow the back support to accommodate buckets having different widths, and wherein the method comprises:

joining the first left bar at right angles to the left side post to form the left support;

joining the first right bar at right angles to the right side post to form the right support; and joining the first bar to the support plate to form the back support;

wherein the back support is:

laterally displaceable relative to the left and right side posts, and anchored to at least one of the first left or right bar, in the state where the back guard is attached to the bucket to prevent the back support from laterally displacing relative to the left and right supports during use.

* * * * *